United States Patent [19]

Petrzelka et al.

[11] Patent Number: 4,649,585

[45] Date of Patent: Mar. 17, 1987

[54] APPARATUS FOR ROUGHENING THE MARGIN OF LASTED FOOTWEAR

[75] Inventors: Antonin Petrzelka, Gottwaldov; Rudolf Pseja, Frystak, both of Czechoslovakia

[73] Assignee: Tovarny Strojirenske Techniky, Koncern, Prague, Czechoslovakia

[21] Appl. No.: 843,980

[22] Filed: Mar. 25, 1986

[30] Foreign Application Priority Data

Mar. 25, 1985 [CS] Czechoslovakia ..... 2112-85

[51] Int. Cl.[4] ..... A43D 95/00; C14B 1/44

[52] U.S. Cl. ..... 12/17.2; 12/77; 12/78; 69/6.5

[58] Field of Search ..... 12/17.2, 70.5, 70, 77, 12/78, 79.3, 1 R; 69/6.5

[56] References Cited

U.S. PATENT DOCUMENTS

| | | | |
|---|---|---|---|
| 3,733,632 | 5/1973 | Bechtold | 12/1 R |
| 3,975,932 | 8/1976 | Vornberger | 12/77 |
| 4,090,378 | 5/1978 | Sommer | 69/6.5 |
| 4,126,020 | 11/1978 | Tutt et al. | 12/77 |
| 4,324,118 | 4/1982 | Bruggi | 69/6.5 |
| 4,452,057 | 6/1984 | Davies et al. | 69/6.5 |
| 4,555,823 | 12/1985 | Pedretti et al. | 12/77 |
| 4,561,139 | 12/1985 | Becka et al. | 12/1 R |

*Primary Examiner*—Louis K. Rimrodt
*Assistant Examiner*—Steven N. Meyers

[57] ABSTRACT

An apparatus for roughening the margin of lasted footwear uppers, comprising a body of a roughening head which is adapted for moving toward an article of semi-finished footwear, the holder of which article is supported by a table board rotatable about a vertical axis. The body of the roughening head is mounted in a carrier fork which is mounted in the machine frame and the table board of the holder is provided on a tiltable support platform which is journalled in a bracket of the machine frame.

6 Claims, 3 Drawing Figures

APPARATUS FOR ROUGHENING THE MARGIN OF LASTED FOOTWEAR

BACKGROUND OF THE INVENTION

The invention relates to an apparatus, for roughening the margin of lasted footwear, wherein the body of the roughening head is movable toward and away from a semi-finished article of footwear, and the holder of the article of footwear is supported by a table board rotatable about a vertical axis.

A known apparatus for roughening the margin of lasted footwear comprises a table board rotatable about a vertical axis the position of which relative to the machine frame is invariable. A holder for the footwear to be processed is mounted for horizontal reciprocation on said table board. The known apparatus also includes a horizontally reciprocating support carrying a tiltable roughening head which is provided with a rotary roughening brush.

A substantial disadvantage of such an arrangement is that between the operator's post and the semi-finished footwear holder there exists a relatively large distance which is given by the maximum constructional distance between the elements connected with the table board and the vertical axis of rotation as well as by the constructional dimension of a necessary guard railing. Because of this large distance between the operator and the footwear holder, the placing of the semi-finished footwear in and the removal thereof out of the machine is made considerably difficult and laborius for the operator. In order to place the semi-finished footwear in the machine and to remove it out of the machine after machining, the support has to be horizontally shifted away and the roughening head has to be tilted in the direction away from the semi-finished footwear holder. During the backward motion in the direction toward the footwear holder, i.e. at the beginning of the work cycle, it is necessary that simultaneously as the roughening brush bears on the uppers margin and as tracing rolls bear on the periphery of the semi-finished footwear, the rotary motion of the table board together with the footwear holder may begin. This requires a very exact synchronization of the reciprocatory support movement, the tilting movement of the roughening head and the rotary movement of the table board. If this synchronization is not effected, the uppers margin in the region of initial contact with the roughening brush either gets excessively roughened or fails to be roughened at all. Control means apt to attain such a degree of synchronization are relatively complicated and expensive and prone to failure.

SUMMARY OF THE INVENTION

It is an object of the present invention to eliminate the disadvantages of the prior art as hereinabove set forth and to provide an improved apparatus for roughening the margin of lasted footwear. According to the invention, the body of the roughening head is mounted in a carrier fork which is movably mounted on the machine frame. The table board of the holder for the semifinished footwear is mounted on a support platform which is journalled in a bracket of the machine frame by means of side pivots. The support platform is coupled to the piston rod of a first pressure cylinder attached to the bracket of the machine frame. The piston rod of the first pressure cylinder is coupled to the support platform by one arm of lower toggle levers, the second arm of which is attached to the machine frame. The carrier fork is provided with a first extension coupled to the lower arm of upper toggle levers, the upper arm of which is attached, on the one hand to a transverse tie rod coupled to the carrier fork and, on the other hand to a bush lever receiving an arresting strut which is coupled to the body of the roughening head while the upper toggle levers are moreover attached to the piston rod of a second pressure cylinder coupled to a second extension of the carrier fork. The body of the roughening head is coupled to a third pressure cylinder, the piston rod of which is attached to a third extension of the carrier fork. The body of the roughening head is also coupled to a fourth pressure cylinder, the piston rod of which is attached to the machine frame.

A primary advantage of the present invention is that the arrangement of the table board on the tiltable support platform enables the footwear holder to be swung toward the operator whereby the placing of the footwear in the machine and the removal thereof out of it is considerably simplified. At the start of the work cycle, the body of the roughening head is immobilized by the arresting strut in such a position which corresponds to a synchronous contact between the roughening brush and the margin of the lasted footwear uppers as well as to the instant in which the tracing roll bears onto the periphery of the semi-finished footwear to be processed. this prevents the margin of the footwear uppers from being either excessively roughened, or on the contrary, insufficiently roughened at the place of the initial contact with the roughening brush. The first pressure cylinder is designed for tilting the support platform by means of lower toggle levers within a preferable speed course. The third pressure cylinder serves in turn for tilting, during the overall roughening cycle, the body of the roughening head together with the roughening brush toward the margin of lasted footwear. Finally, the fourth pressure cylinder is adapted to tilt the carrier fork together with the body of the roughening head, depending on the changes in shift of a connecting rod coupled with the tracing roll.

BRIEF DESCRIPTION OF THE DRAWINGS

With these and other objects in view, which will become apparent in the following detailed description, the present invention, which is shown by example only, will be clearly understood in connection with the accompanying drawing, in which.

DETAILED DESCRIPTION OF THE PREFERRED EMBODIMENT

Figure 1:
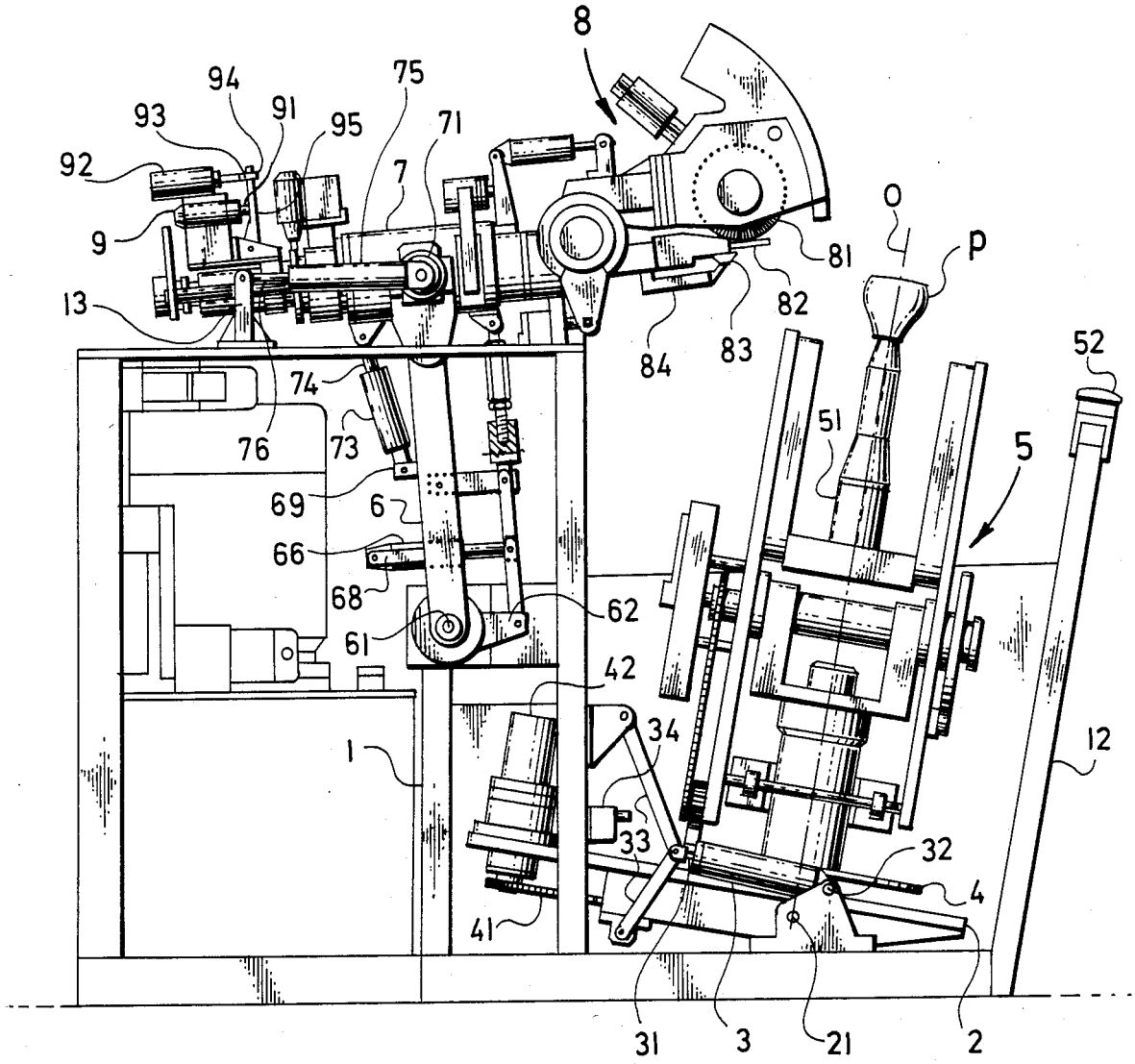
FIG. 1 shows a side elevation view of the roughening apparatus in the initial position.

As can be seen in the drawings, and particularly FIG. 1 thereof, the apparatus of the present invention comprises a machine frame 1. A bracket 11 is secured to a projecting lower part of the frame 1, to which bracket 11 a support platform 2 is journalled by means of side pivots 21. The bracket 11 has a central pivot 32 carrying a first pressure cylinder 3, the piston rod 31 of which is coupled to lower toggle levers 33. The lower arm of said toggle levers 33 is connected to said support platform 2 while its upper arm is connected to the frame 1. Opposite the lower toggle levers 33, there is situated on the frame 1 a terminal switch 34. The supporting platform 2 carries a table board 4 rotatable about an axis a by means of a chain transmission 41 which is coupled to a hydraulic motor 42 secured to the support platform 2. Arranged on the table board 4, is a positioning device 5 together with a holder 51 for the semi-finished footwear p. The positioning device 5 together with said holder 51 is adapted to make a reciprocatory motion in the direction from the heel part to the toe part of the semi-finished footwear to be machined. In front of the positioning device 5 there is provided a guard railing 12 secured to the machine frame 1 and carrying control elements 52.

In the intermediate part of the machine 1, a carrier fork 6 is mounted on a lower shaft 61. The top portion of said fork 6 carries a body 7 of a roughening head 8, which body 7 is journalled on upper pivots 71. The carrier fork 6 is provided with a first extension 62 coupled with the lower arm of upper toggle levers 63, the upper arm of which is connected to a transverse tie rod 64 and a bush lever 65. The transverse tie rod 64 is coupled to said carrier fork 6. In the interior of said bush lever 65, there is received an arresting strut 72 connected to the body 7 of the roughening head 8. Apart from this, the upper toggle levers 63 are coupled with the piston rod 67 of a second pressure cylinder 66, which cylinder 66 is connected to a second extension 68 of the carrier fork 6. Further, the body 7 of the roughening head 8 is coupled with a third pressure cylinder 73, the piston rod 74 of which is connected to a third extension 69 of the carrier fork 6. To the body 7 of the roughening head 8, there is also coupled a fourth pressure cylinder 75, the piston rod 76 of which is connected to an upper bracket 13 provided on the machine frame 1. Said fourth pressure cylinder 75 is connected to a pressurized medium distributor 9 provided with a valve 91 which cooperates with a twin arm control lever 95. By one of its ends, the twin arm control lever 95 is received in a groove 94 provided in the piston rod 93 of an auxiliary pressure cylinder 92. In the front portion of the roughening head 8, there is arranged a roughening brush 81 adapted to a rotary movement derived from a drive unit (not shown). Under the roughening brush 81, two tracing fingers 82 are provided on the roughening head 8 and below them is disposed a tracing roll 83. The tracing roll 83 is supported on a connecting pull rod 84 which passes movably through the body 7 of the roughening head 8 and is connected to the bottom end of the twin arm control lever 95 of the pressurized medium distributor 9. Thus, the tracing roll 83 together with the twin arm control lever 95 of the pressurized medium distributor 9 and the auxiliary pressure cylinder 92 form a servo mechanism with a mechanical feedback for controlling the operation of the fourth pressure cylinder 75.

In the initial or inoperative position shown in FIG. 1, the piston rod 31 of the first pressure cylinder 3 is retracted so that the support platform 2 is tilted away about the side pivots 21 by means of the lower toggle levers 33 whereby the axis a is inclined toward the guard railing 12 and, consequently, towards the operator's post. The piston rod 93 of the auxiliary pressure cylinder 92 is also retracted so that valve 91 of the pressurized medium distributor 9 is closed. In this position of the valve 91, the piston rod 76 of the fourth pressure cylinder 75 is retracted so that the complete carrier fork 6 together with the body 7 of the roughening head 8 is tilted away on the lower shaft 61 into the rear most position relative to the guard railing 12. The piston rod 67 of the second pressure cylinder 66 is extended so that the upper toggle levers 63 are in a straight position and the arresting strut 72 bears on the bottom bush lever 65. Thus, the body 7 of the roughening head 8 is prevented from swinging in the carrier fork 6 about the upper pivots 71.

Figure 2:
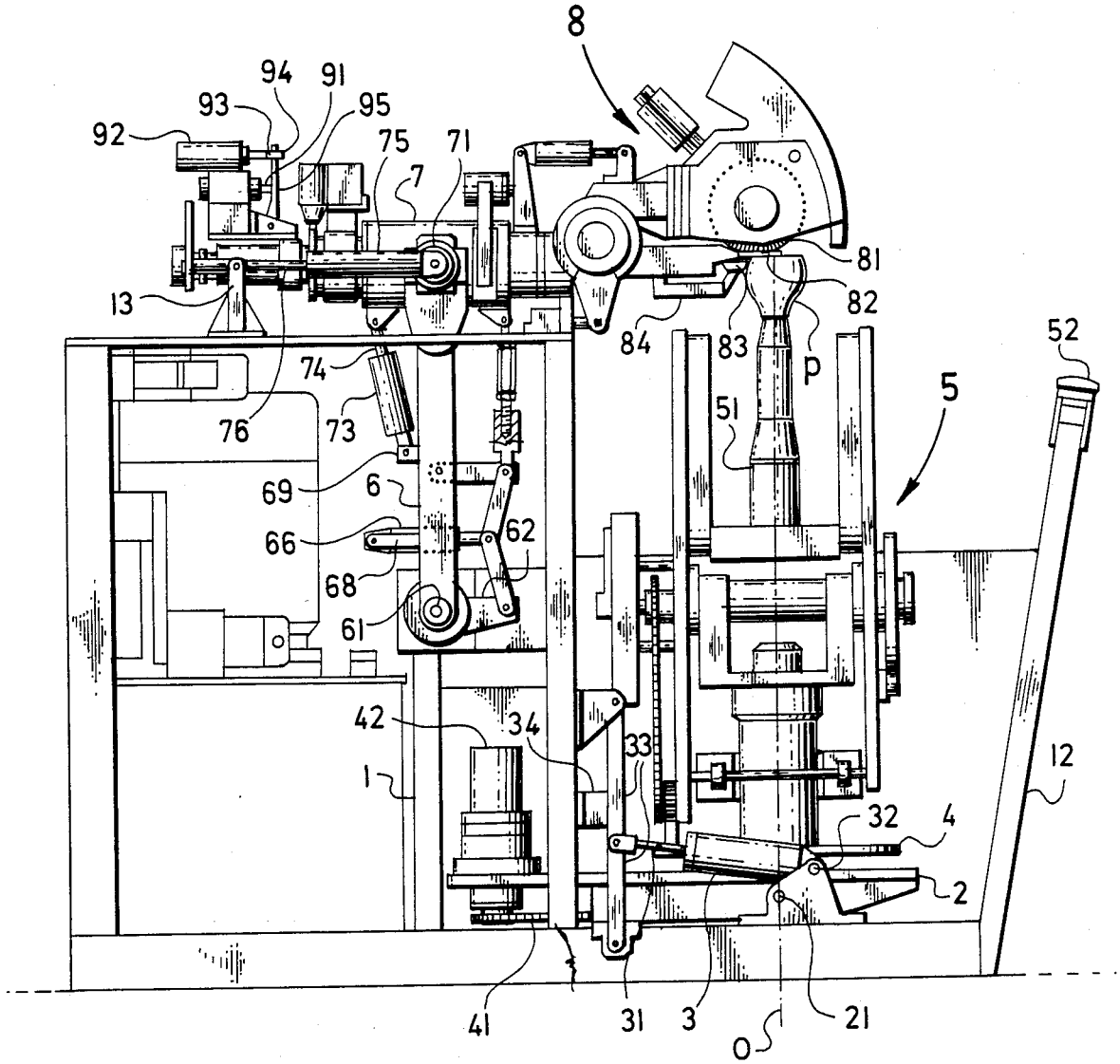
FIG. 2 shows a similar view of the apparatus in the initial phase of the margin roughening process.

In this above-described initial position, the operator places the semi-finished footwear p on the holder 51 and switches on the corresponding control elements 52. In this way, the first pressure cylinder 3 and also after a controllable delay, the auxiliary pressure cylinder 92 and, consequently, the fourth pressure cylinder 75 are set in motion. The piston rod 31 begins to push the lower toggle levers 33, the lower arm of which begins to tilt the support platform 2 about the side pivots 21 into horizontal position so that the axis a of the table board 4 assumes a vertical position. Due to the operation of the fourth pressure cylinder 75, its piston rod 76 begins to extend and the carrier fork 6 together with the body 7 of the roughening head 8 begins to swing on the lower shaft 61 toward the semi-finished footwear p. The delayed start of the auxiliary pressure cylinder 92 and, consequently, the resetting of the pressurized medium distributor for the fourth pressure cylinder 75 is chosen so as to cause the tracing roll 83 to bear on the periphery of the semi-finished footwear p in the instant in which the axis a of the table board 4 has assumed the vertical position. As the lower toggle levers 33 near a straight position, they switch on the terminal switch 34 which sets in operation the second pressure cylinder 66 whereby its piston rod 67 retracts. The upper toggle levers 63 are pulled in, the bush lever 65 is displaced downwards and the arresting strut 72 releases the body 7 of the roughening head 8 in the carrier fork 6. Due to the subsequent action of the third pressure cylinder 73, its piston rod 74 extends and tilts the body 7 of the roughening head 8 in the carrier fork 6 about the upper pivot 71 until the rotary roughening brush 81 bears on the margin of the lasted footwear p to be processed. This phase of the work cycle is shown in FIG. 2. Simultaneously, the hydraulic motor 42 is set in operation and begins, via chain transmission 41, to rotate the table board 4 together with the holder 51 of the semi-finished footwear p through 180°.

Figure 3:
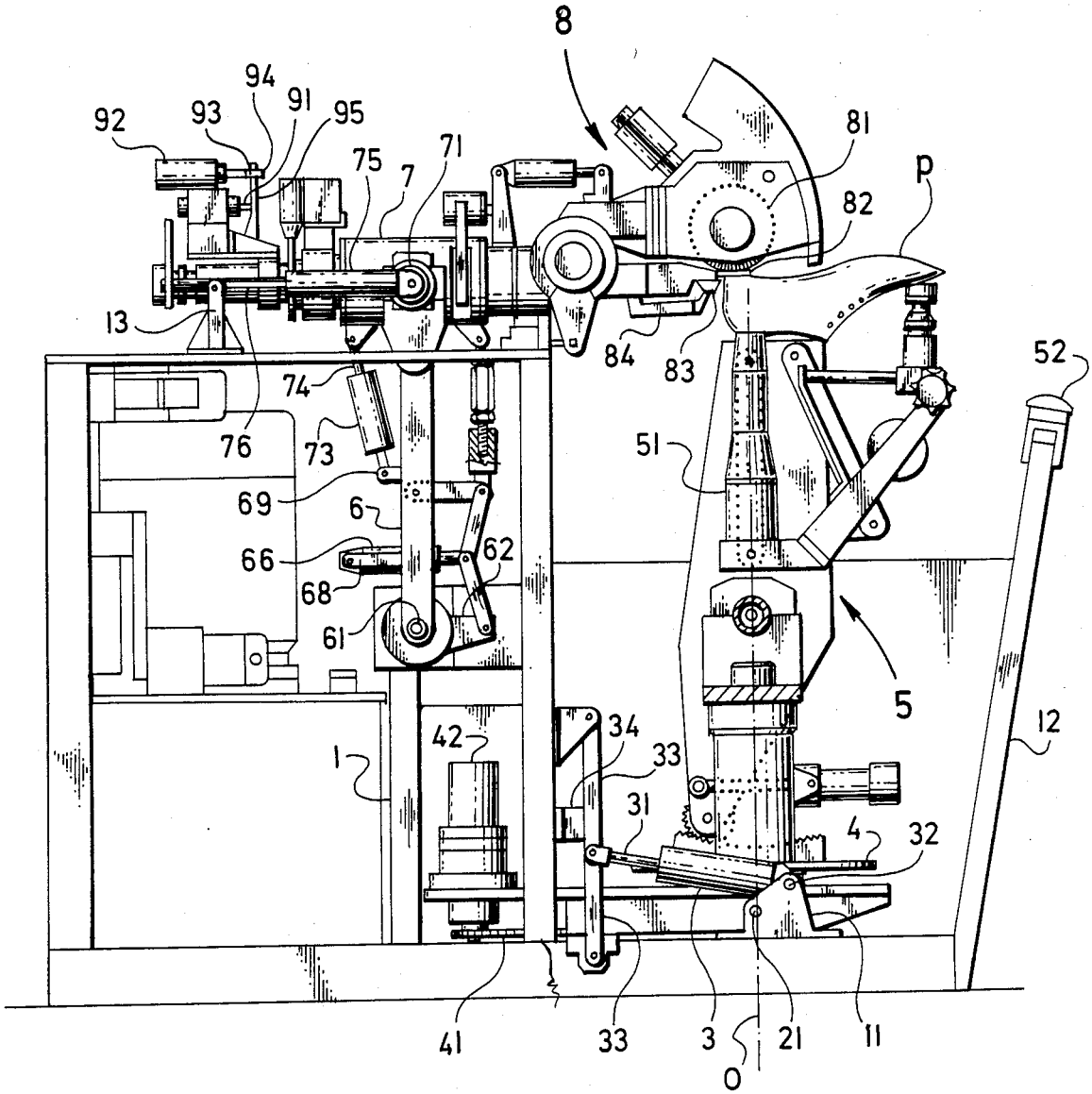
FIG. 3 shows a similar view of the apparatus in the position wherein the heel portion of the margin of lasted footwear uppers is roughened.

FIG. 3 shows the apparatus in course of said rotary movement of the table board 4, and particularly in the instant in which the table board is turned through 90°. During this rotary movement, the roughening brush 81 processes the heel part of the margin of the lasted footwear. This rotary movement of table board 4 is followed by the forward movement of the positioning device 5 during which one of the margin sides is roughened, and by the return of the table board 4 again through 180° during which the toe part of the margin of the lasted footwear is roughened. Finally, the positioning device 5 returns backward while the opposite side portion of the margin is roughened. During all of the above movements the roughening head 8 is vertically guided by the tracing fingers 82, depending upon the changes in the height profile of the last. The piston rod 74 of the third pressure cylinder 73 is continuously swinging the body 7 of the roughening head 8 in the carrier fork 6 about the upper pivot 71 so that the tracing fingers 82 continuously bear on the margin of lasted footwear p to be processed. Simultaneously, the tracing roll 83 is rolling about the external periphery of the semi-finished footwear p while displacing, by the connecting rod 84, the twin arm control lever 95 of the pressurized medium distributor 9, depending upon peripheral changes. The pressurized medium distributor 9 in cooperation with the auxiliary pressure cylinder 92 controls the action of the fourth pressure cylinder 75 in such a way that the roughening brush 81 is continuously lead about the periphery of the footwear uppers margin.

After the entire periphery of margin of the lasted footwear has been roughened, the individual mechanisms are automatically returned into their initial positions whereby the work cycle is ended. The operator removes the worked semi-finished footwear p out of the machine which is thus ready for placing another workpiece and for starting the next work cycle.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. An apparatus for roughening the margin of lasted footwear uppers, comprising a machine frame;

a support platform journalled in a backet of the machine frame by means of side pivots;

a supporting table mounted on said support platform and rotatable about a vertical axis, said table supporting a holder of an article of semi-finished footwear; and a body of a roughening head mounted in a carrier fork, which carrier fork is mounted in the machine frame and is adapted for moving the body toward the article of semi-finished footwear.

2. An apparatus according to claim 1, wherein the support platform is tiltable relative to a vertical axis by means of the piston rod of a first pressure cylinder attached to the bracket of the machine frame.

3. An apparatus according to claim 2, wherein the piston rod of the first pressure cylinder is coupled to the support platform by one arm of lower toggle levers, the second arm of which is attached to the machine frame.

4. An apparatus according to claim 1, wherein the carrier fork is provided with a first extension coupled to the lower arm of upper toggle levers, the upper arm of which is attached, on the one hand, to a transvrse tie rod coupled to the carrier fork and, on the other hand, to a bush lever receiving an arresting strut which is coupled to the body of the roughening head while the upper toggle levers are attached to the piston rod of a second pressure cylinder coupled to a second extension of the carrier fork.

5. An apparatus according to claim 1, wherein the body of the roughening head is coupled to a third pressure cylinder, the piston rod of which is attached to a third extension of the carrier fork.

6. An apparatus according to claim 1, wherein the body of the roughening head is coupled to a fourth pressure cylinder, the piston rod of which is attached to the machine frame.

* * * * *